US012371247B2

(12) United States Patent
Iriti et al.

(10) Patent No.: US 12,371,247 B2
(45) Date of Patent: Jul. 29, 2025

(54) PACK OF FOLDED SHEETS, A DISPENSER AND A SYSTEM COMPRISING DISPENSER PACK

(71) Applicant: SOFIDEL S.P.A., Porcari (IT)

(72) Inventors: Marco Iriti, Porcari (IT); Vincenzo Liuzzo, Porcari (IT); Simone Donati, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 149 days.

(21) Appl. No.: 18/326,156

(22) Filed: May 31, 2023

(65) Prior Publication Data

US 2023/0391537 A1 Dec. 7, 2023

(30) Foreign Application Priority Data

Jun. 7, 2022 (IT) ..... 102022000011969

(51) Int. Cl.
*B65D 83/08* (2006.01)

(52) U.S. Cl.
CPC ..... *B65D 83/0805* (2013.01); *B65D 83/0894* (2013.01); *B65D 2583/082* (2013.01)

(58) Field of Classification Search
CPC ..... B65D 83/0805
See application file for complete search history.

(56) References Cited

U.S. PATENT DOCUMENTS

| | | | | |
|---|---|---|---|---|
| 2,142,808 | A | 1/1939 | Gustav | |
| 3,343,716 | A * | 9/1967 | Peebles | B65D 83/0817 221/197 |
| 5,007,558 | A | 4/1991 | Allen et al. | |
| 8,205,748 | B2 * | 6/2012 | Long | A47K 10/421 221/33 |
| 2006/0049199 | A1 * | 3/2006 | West | A61B 42/40 221/26 |
| 2013/0228588 | A1 * | 9/2013 | Biegger | B65D 83/0847 221/45 |
| 2013/0248552 | A1 * | 9/2013 | Bauer | B32B 29/06 428/137 |

FOREIGN PATENT DOCUMENTS

| | | | |
|---|---|---|---|
| EP | 2682352 | A1 | 1/2014 |
| WO | 2013052223 | A1 | 4/2013 |

* cited by examiner

*Primary Examiner* — Gene O Crawford
*Assistant Examiner* — Ayodeji T Ojofeitimi
(74) *Attorney, Agent, or Firm* — McGlew and Tuttle, P.C.

(57) ABSTRACT

The package interfolded sheets comprising at least one punching which passes through each of said sheets forming a continuous channel extending from an upper face to a lower face of the interfolded sheet pack. A sheet pack dispenser has protuberances complementary to the continuous channel, so that the dispenser can only accept the paper packs dedicated to the dispenser and not others.

14 Claims, 4 Drawing Sheets

Fig.1A
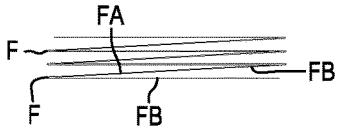
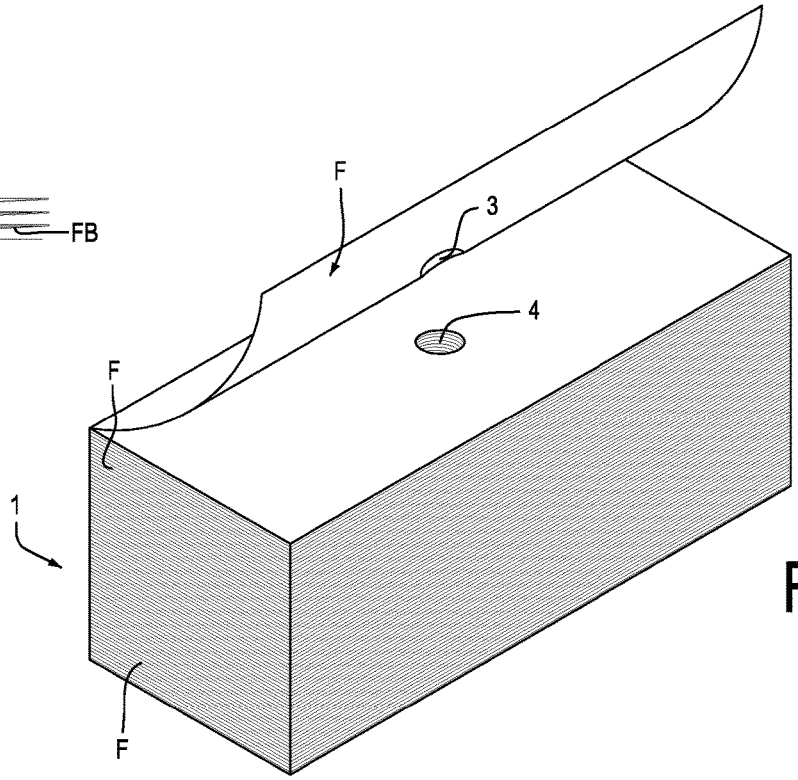
Fig.1
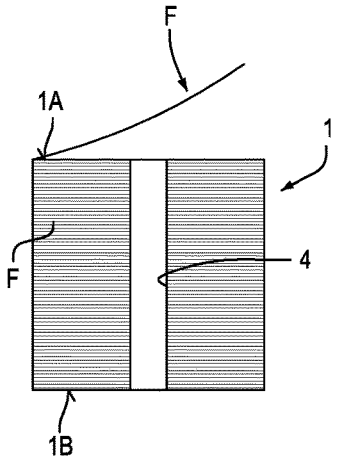
Fig.2
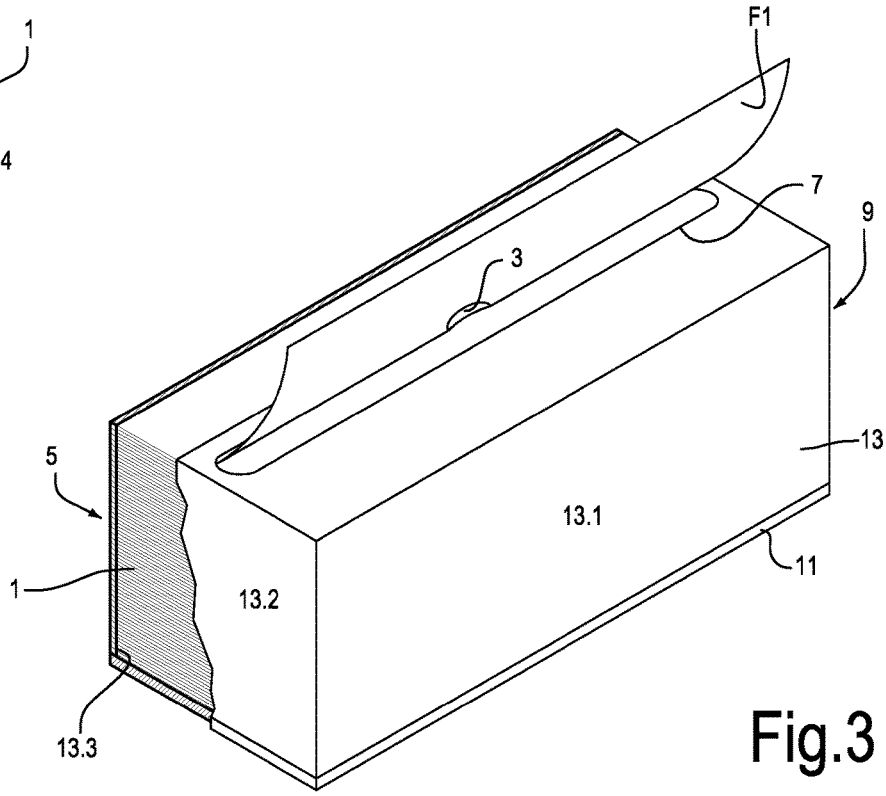
Fig.3

PACK OF FOLDED SHEETS, A DISPENSER AND A SYSTEM COMPRISING DISPENSER PACK

TECHNICAL FIELD

The present invention relates to the field of cellulosic products and similar sheet products for personal hygiene and the like, packaged in packs of interfolded sheets.

Background Art

Many cellulosic sheet products are currently packaged in packs or bundles of interfolded sheets, i.e. folded so that each sheet has its own portion within folded portions of the adjacent sheet. In this way, by inserting the bundle or pack of interfolded sheets into a dispenser with a withdrawal opening, it is possible to withdraw the single interfolded sheets individually and in sequence so that the extraction of each sheet involves the partial extraction of one edge of the next sheet, making it easier for the user to pick up this latter.

The present invention relates to improvements to packs, bundles or packages of interfolded sheets and to the relative dispensers.

SUMMARY OF THE INVENTION

According to a first aspect, the invention relates to a package or pack of interfolded rectangular sheets comprising at least one punching which passes through each of said sheets thus forming a continuous channel extending from an upper face to a lower face of the interfolded sheet pack.

The pack of interfolded sheets thus configured can be inserted into a suitable dispenser.

The dispenser comprises a container defining a cavity with a rectangular cross section, for receiving a stack of interfolded sheets. At least one protuberance extending between the base and the lid is integral with the container.

The protuberance is internal to the rectangular cross section of the cavity of the dispenser container.

The dispenser is adapted to receive only packs or packages which include punchings of a shape complementary to the shape of the protuberance. In this way, it is easy to avoid combining packages or packs of sheets with unsuitable dispensers.

According to another aspect, the invention provides a system comprising a stack of interfolded sheets, which sheets have a rectangular shape, having at least one punching through each of said sheets. The punching forms a continuous channel extending from an upper face to a lower face of the interfolded sheet pack. The system further comprises a dispenser for interfolded sheets, comprising a container defining a cavity for receiving a pack of interfolded sheets. The cavity may be delimited laterally by flat walls and has a rectangular cross-section. The container includes a base and a lid. The base and the lid define, together with the side walls, the containment cavity of the pack of interfolded sheets. The lid includes an opening for withdrawing sheets from the cavity. Furthermore, at least one protuberance inside the cavity and extending between the base and the lid is integral with the container. In particular, the protuberance is advantageously placed inside the side walls delimiting the cavity.

The channel formed in the rectangular sheet pack complements the protuberance within the cavity of the container, so that as the pack is inserted into the container, the protuberance extends into the channel formed by the overlapping punch marks of the interfolded sheet pack. The protuberance prevents the insertion into the container cavity of a package lacking a channel complementary to the protuberance.

BRIEF DESCRIPTION OF THE DRAWINGS

The accompanying drawings show:

FIG. 1 a pack or ream of interfolded sheets;

FIG. 1A is a schematic enlargement of a portion of the pack of interfolded sheets;

FIG. 2 is a cross section along a vertical plane of the pack of FIG. 1;

FIG. 3 an axonometric view of a dispenser containing a pack of interfolded sheets of FIG. 1;

DETAILED DESCRIPTION

Figure 4:
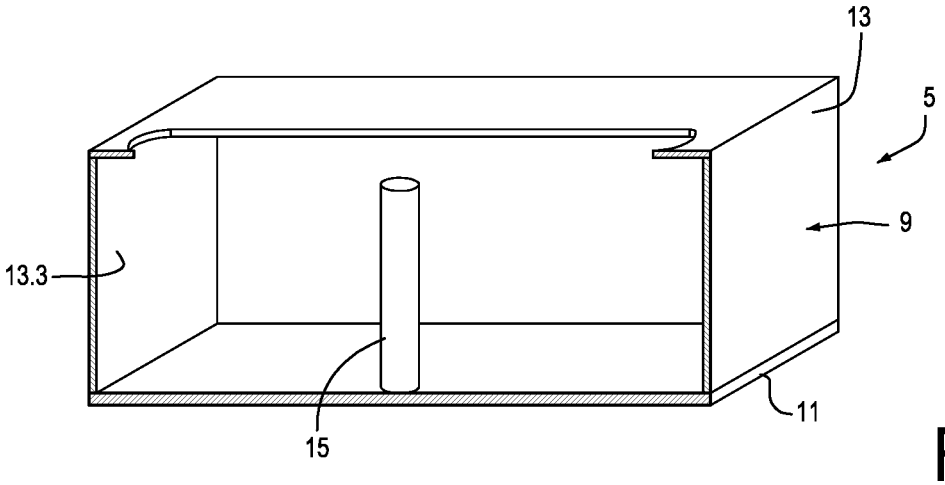
FIG. 4 is a section in axonometric view of the dispenser of FIG. 3 without sheets inside it.

In FIG. 1 a pack, bundle or package of interfolded sheets is shown in one possible embodiment. The pack is indicated with 1 and F indicates the single interleaved sheets which form the pack. FIG. 1A schematically shows the ways in which the sheets F of pack or bundle 1 are folded and interleaved. The folding method of the sheets F may be different from the one schematically illustrated in FIG. 1A.

Each sheet has a rectangular shape. When folded, each sheet still has a rectangular shape, being folded along one or more fold lines parallel to one of the straight edges of the sheet. Consequently, the bundle or pack of folded and interfolded sheets F has a parallelepiped shape with a rectangular base. The term rectangular also includes the particular case of a square shape, i.e. rectangular with equal sides.

Basically, in this embodiment each sheet F has an intermediate fold P, parallel to two opposite straight edges, which divides the sheet into two parts FA and FB, such that between each pair of portions FA, FB of a folded sheet a portion FB of a previous sheet and a portion FA of a subsequent sheet is inserted.

In this way, when pack 1 of sheets F is placed into a dispenser, each sheet can be taken from an opening of the dispenser dragging with it an edge of the next sheet which is arranged inside the withdrawal opening to be extracted by the user in the next withdrawal.

As can be seen in particular in FIGS. 1 and 2, in this embodiment each sheet F of the bundle or pack 1 has a central punching 3, which is circular in the exemplary embodiment.

The various punchings 3 of each sheet F are superimposed on each other inside the bundle or pack 1 so as to form a channel 4 which extends from the first sheet 1A, forming the upper face of the pack 1, to the last sheet forming the bottom face 1B of pack or bundle 1.

FIG. 3 illustrates a dispenser 5 inside which the bundle or package 1 is arranged, as visible in the removed part of the dispenser 5. F1 indicates the upper sheet of the pack 1 which is partially located outside an opening 7 for withdrawing the single sheets F from the dispenser 5. In the illustrated embodiment, the dispenser 5 comprises a container 9 comprising a base 11 and a lid 13.

Figure 5:
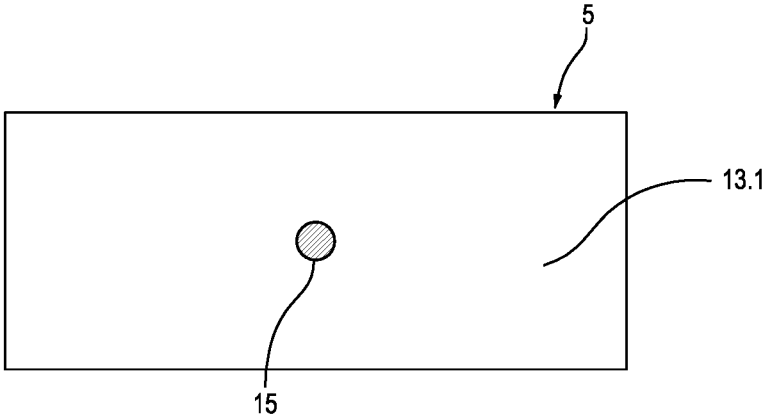
FIG. 5 is a plan view of the dispenser of FIG. 4 without lid.
Figure 6:
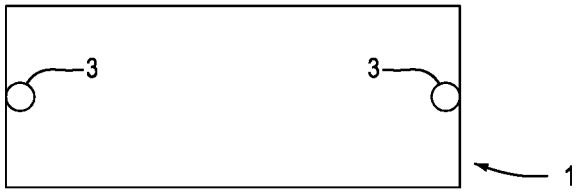
FIGS. 6 to 11 plan views of packs or bundles of interfolded sheets according to other embodiments.

The opening 7 is made in the lid 13. In the illustrated embodiment, the lid 13 has side walls 13.1, 13.2 which delimit a cavity 13.3 for receiving the package or bundle. FIGS. 4 and 5 show the dispenser empty, i.e. without sheets inside.

The container 9 has a shape which is complementary to that of the pack or bundle 1 of sheets; therefore, the cavity 13.3 for receiving the pack 1 of sheets has, in a plan view, i.e. in cross section, a substantially rectangular shape. The cavity is laterally delimited by flat walls at right angles to each other.

Inside the cavity 13.3, in which the pack or bundle 1 of sheets F of the dispenser 5 is to be housed, there is a protuberance 15 (FIGS. 4, 5) of a shape complementary to the channel 4 formed inside the pack 1 by the punchings 3 of the single sheets F forming the pack 1 itself.

Conveniently, the protuberance is located within the volume delimited by the flat side walls, which constitutes the cavity in which the pack 1 of interfolded sheets is housed.

In the embodiment of FIGS. 4 and 5, since the protuberance 15 must be inserted into a channel 4 formed by the overlapping of circular punchings, the protuberance 15 has the shape of a small rod with a circular cross section, or in any case a cross-section corresponding to the cross-section of the channel 4 and thus of the punching 3. In the illustrated embodiment, as may be seen in the axonometric view of FIG. 4 and in the plan view of FIG. 5, where the lid 13 has been removed, the protuberance 15 is applied to the bottom of the base 11 and extends upwards, i.e. towards the upper part of the lid 13. When the bundle or pack 1 of interfolded sheets F is inserted into the cavity 13.3, the insertion is made possible by the fact that the protuberance 15 is housed inside the channel 4 formed by the superimposed punchings 3 of the single sheets F.

Inside the dispenser 5 illustrated in FIGS. 4 and 5, only a pack or bundle 1 with punchings 3 forming the channel 4 with a shape complementary to the shape of the protuberance 15 may exclusively be inserted.

In this way it can be ensured that there are no errors by the user in inserting a pack of interfolded sheets F inside the respective dispenser. In other words, if for example it is desired to use a certain dispenser for a certain type of sheet, the use of channels 4 and protuberances 15 of complementary shapes avoids the erroneous use of a pack of sheets with an inappropriate dispenser.

The protuberances 15 and the channels 4 which can be used for this purpose can have a shape different from that illustrated with reference to FIGS. 1 to 5.

FIGS. 6 to 11 illustrate exemplary embodiments in a plan view of packs 1 having sheets with differently shaped punchings. More particularly, in FIG. 6 the sheets F of the pack 1 have punchings 3 made near the short sides of the folded sheet. The punchings 3 still have a circular shape.

Figure 7:
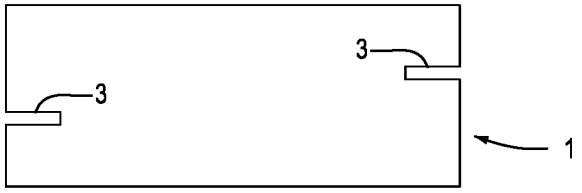

In FIG. 7 the punchings, still indicated with 3, have the shape of notches that start from the short sides of the folded sheets F forming the pack 1. The notches 3 have an elongated rectangular shape.

Figure 8:
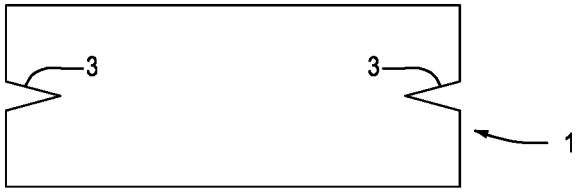

In FIG. 8 there are still two opposite notches 3 made along the short sides of each sheet F forming the pack 1, V-shaped and aligned along an intermediate line of the pack 1.

Figure 9:
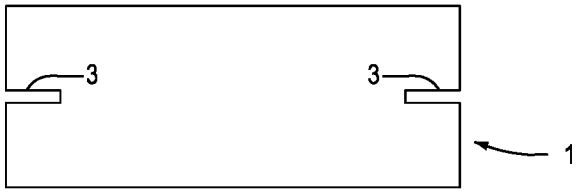

In FIG. 9 the notches 3 are still aligned as in FIG. 8, but have a rectangular shape as in FIG. 7.

Figure 10:
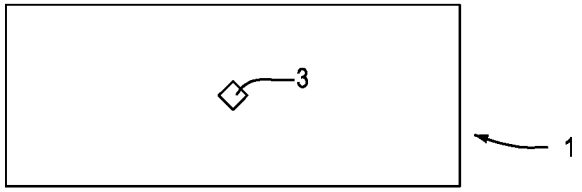
Figure 11:
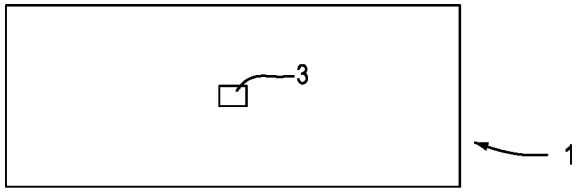

FIGS. 10 and 11 show a plan view of packs of sheets F provided with central punchings 3, similarly to what is illustrated in FIGS. 1 to 3, but in this case the punchings 3 are rhomboidal and rectangular in shape, respectively.

The various packs 1 of FIGS. 6 to 10 are intended to be inserted into dispensers provided with protuberances 15 having a shape complementary to the channels which are generated by the overlapping of the sheets F punched at 3 according to the various embodiments.

Figure 12:
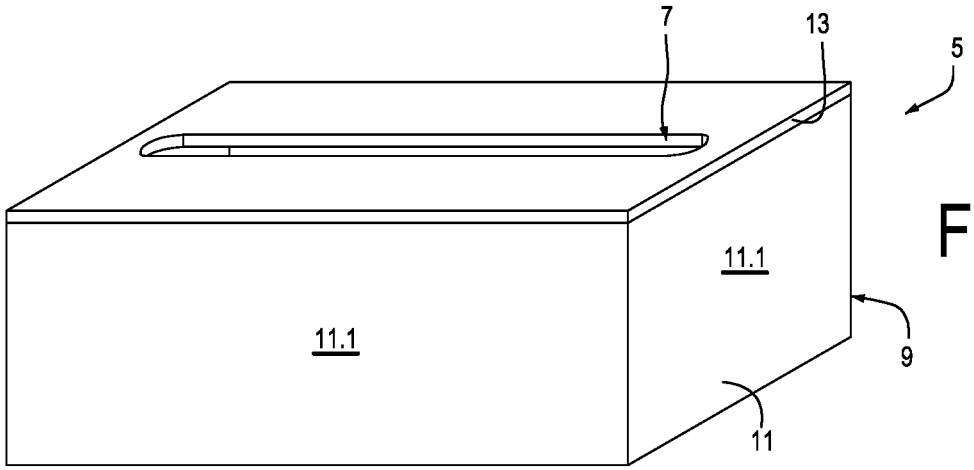
FIG. 12 axonometric view of a further embodiment of a dispenser.
Figure 13:
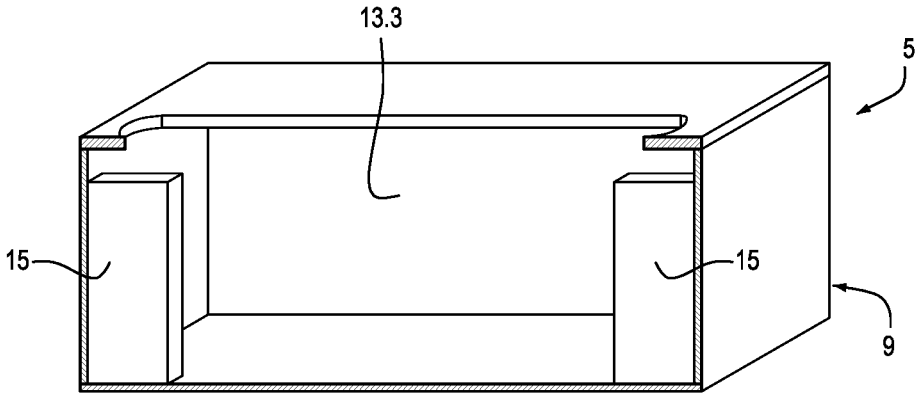
FIG. 13 is an axonometric section of the dispenser of FIG. 12.
Figure 14:
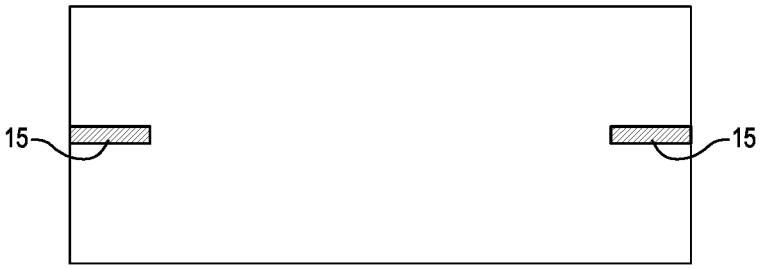
FIG. 14 is a plan view, with the lid removed, of the dispenser of FIGS. 12 and 13.

FIGS. 12, 13 and 14 show by way of example a dispenser, again indicated with 5, for pack 1 of sheets F of FIG. 9. In this embodiment, therefore, inside the cavity 13.3 of the dispenser 5 there are two protuberances, again indicated with 15, whose shape is complementary to the shape of the notches defining the punchings 3 (FIG. 7) extending in symmetrical positions from the two short sides of the single folded sheets F.

By way of example, in FIGS. 12, 13 and 14 the base 11 of the dispenser 5 forms the side walls, indicated here with 11.1, while the lid 13 forms the dispensing opening, again indicated with 7.

In general, whatever the shape of the dispenser and of the pack of overlapped interfolded sheets, the pack will always be characterized by one or more channels formed by the overlapping of punching, perforations or notches of the single folded sheets F, while inside the cavity 13.3 of the dispenser 5 there will be one or more protuberances 15 of a complementary shape to the channels 3 formed in the pack 1 of sheets F.

In this way, the pack 1 of sheets F can always and only be used with a dispenser 5 specifically configured to receive it. It will not be possible to use the dispenser with packs of sheets not provided with punching complementary to the protuberances contained inside the container formed by the base and cover of the dispenser 5.

What is claimed is:

1. A system comprising:

a pack of interfolded rectangular sheets comprising at least one punched hole that passes through each of said sheets forming a continuous channel extending from an upper face to a lower face of the pack of interfolded rectangular sheets; and a dispenser comprising a container defining a cavity, having a rectangular cross-section, for receiving the pack of interfolded rectangular sheets, wherein the container comprises a base and a removable cover opposite the base, the cavity being formed between the base and the opposite removable cover; wherein the removable cover comprises an opening for removing sheets from the cavity; the dispenser further comprising at least one protuberance integral with the container and extending between the base and the cover and orthogonally to the base and the cover;

wherein the channel is complementary to the protuberance, so that when the pack is inserted into the container, the protuberance extends in the channel formed by the punched holes superimposed on one another of the pack of interfolded sheets; and wherein the protuberance prevents a pack without a channel complementary to the protuberance from being inserted into the cavity of the container.

2. The system of claim 1, wherein the protuberance is integral with the base of the container and projects therefrom into the cavity.

3. The system of claim 1, wherein the protuberance is integral with the cover and projects therefrom into the cavity when the cover is positioned opposite the base.

4. The system of claim 1, wherein the container comprises lateral walls integral with the base or with the cover.

5. A system comprising:

a pack of interfolded rectangular sheets comprising at least one punched hole that passes through each of said sheets forming a continuous channel extending from an upper face to a lower face of the pack of interfolded rectangular sheets; and a dispenser comprising a container defining a cavity, having a rectangular cross-section, for receiving the pack of interfolded rectangular sheets, wherein the container comprises a base and a detachable cover arranged opposite the base, the base and the detachable cover defining the cavity, wherein the detachable cover comprises an opening for removing sheets from the cavity, the dispenser further comprising at least one protuberance integrally connected with the container, the at least one protuberance extending between the base and the cover, the at least one protuberance being orthogonal to the base and the cover, wherein the channel is complementary to the protuberance, such that when the pack is inserted into the container, the protuberance extends in the channel formed by the punched holes superimposed on one another of the pack of interfolded sheets, wherein the protuberance prevents a pack without a channel complementary to the protuberance from being inserted into the cavity of the container.

6. The system of claim 5, wherein the protuberance is integrally connected with the base of the container and projects therefrom into the cavity.

7. The system of claim 5, wherein the protuberance is integrally connected with the cover and projects therefrom into the cavity when the cover is positioned opposite the base.

8. The system of claim 5, wherein the container comprises lateral walls integrally connected with the base or with the cover.

9. The system of claim 5, wherein at least a portion of one end of the at least one protuberance faces in a direction of the opening, the portion of the one end of the at least one protuberance being located opposite a side of the cover comprising the opening.

10. A system comprising:

a pack of interfolded rectangular sheets comprising at least one punched hole that passes through each of said sheets forming a continuous channel extending from an upper face to a lower face of the pack of interfolded rectangular sheets; and a dispenser comprising a container comprising a base and a detachable cover opposite the base, the base and the detachable covering defining a cavity for receiving the pack of interfolded rectangular sheets, the cavity having a rectangular cross-section, wherein the detachable cover comprises an opening for removing sheets from the cavity, the dispenser further comprising at least one protuberance integrally connected with the container, the at least one protuberance extending between the base and the cover, the at least one protuberance being perpendicular to the base and the cover, wherein the channel is complementary to the protuberance, such that when the pack is inserted into the container, the protuberance extends in the channel formed by the punched holes superimposed on one another of the pack of interfolded sheets, wherein the protuberance prevents a pack without a channel complementary to the protuberance from being inserted into the cavity of the container.

11. The system of claim 10, wherein the protuberance is integrally connected with the base of the container and projects therefrom into the cavity.

12. The system of claim 10, wherein the protuberance is integrally connected with the cover and projects therefrom into the cavity when the cover is positioned opposite the base.

13. The system of claim 10, wherein the container comprises lateral walls integrally connected with the base or with the cover.

14. The system of claim 10, wherein at least a portion of one end of the at least one protuberance faces in a direction of the opening, the portion of the one end of the at least one protuberance being located opposite a side of the cover comprising the opening.

* * * * *